US005322282A

United States Patent [19]

Lund et al.

[11] Patent Number: 5,322,282

[45] Date of Patent: Jun. 21, 1994

[54] VARIABLE RESPONSE BALL RECEIVING DEVICE

[75] Inventors: John L. Lund, Des Plaines; Joseph E. Kaminkow, Arlington Heights, both of Ill.

[73] Assignee: Data East Pinball, Inc., Melrose Park, Ill.

[21] Appl. No.: 88,174

[22] Filed: Jul. 7, 1993

[51] Int. Cl.[5] ..... A63F 7/30

[52] U.S. Cl. ..... 273/118 R; 273/127 C; 273/127 D; 273/127 R; 273/129 S; 273/129 V; 273/121 A; 273/118 A; 273/118 D

[58] Field of Search ..... 273/118-121, 273/127 R, 127 B, 127 C, 127 D, 129 R, 129 S, 129 V

[56] References Cited

U.S. PATENT DOCUMENTS

| | | | |
|---|---|---|---|
| 3,627,318 | 12/1971 | Garbary et al. | 273/121 A |
| 3,642,284 | 2/1972 | Kordek | 273/127 R |
| 4,634,126 | 1/1987 | Kimura | 273/121 A X |
| 4,981,298 | 1/1991 | Lawlor et al. | 273/121 A |
| 4,991,846 | 2/1991 | Sondej | 273/127 R |

*Primary Examiner*—Vincent Millin
*Assistant Examiner*—Raleigh W. Chiu
*Attorney, Agent, or Firm*—Gerstman, Ellis & McMillin, Ltd

[57] ABSTRACT

A rotatable member is provided for a rolling ball amusement device. The rotatable member defines a ball receiving aperture which is positioned to receive a rolling ball and to cause transfer of kinetic energy from the ball to the rotatable member, to cause the member to rotate to one of a plurality of discrete, temporarily locked rotating positions, with the selection of the particular rotating position depending on the amount of kinetic energy so transferred. Preferably, switches are provided for identifying to the electronic controls of the amusement device the discrete rotating position occupied by the rotatable member. Upon command, the temporary lock of the rotating positions may be released. A spring or the like then rotates the member back to an original, ball-receiving position upon such release, which propels the ball back onto the playfield with a velocity that depends on the particular discrete rotating position achieved.

8 Claims, 2 Drawing Sheets

VARIABLE RESPONSE BALL RECEIVING DEVICE

BACKGROUND OF THE INVENTION

In rolling ball amusement games such as pinball there is a desire for variability and variety of play action.

In present pinball games there are devices such as knock out holes in which, when a ball enters the hole on the playfield, it is knocked out by a solenoid-operated plunger in the hole. However, typically, the force of the "knock out" remains the same, so that the action of the ball coming out of the knock-out hole will be similar from time to time.

Also, horizontal structures which catch balls are known, which throw balls out again with generally constant force each time. It would be desirable for them to operate with varying performance, rather than just constantly propelling the ball with about the same amount of kinetic energy every time out into the field of play.

By this invention, a rolling ball receiving device is provided for rolling ball amusement devices which can receive the ball and respond in a variable manner, propelling the ball out again with a variable kinetic energy from time to time. Also, variable signals can be sent from the device of this invention to a microprocessor of the game, so that aspects of the game can change depending upon the variable signals sent.

DESCRIPTION OF THE INVENTION

In this invention a rolling ball amusement device is provided, such as a pinball game, having a rotatable member and a ball receiving aperture which are positioned to receive a rolling ball. As the rolling ball enters into the aperture, kinetic energy from the ball can be transferred to the rotatable member, to cause the member to rotate to one of a plurality of discrete, temporarily locked rotating positions. The particular rotating position to which the member rotates depends upon the amount of kinetic energy transferred to the rotatable member from the ball, so that different results are achieved depending upon the velocity of the ball as it enters into engagement with the rotatable member in the aperture.

The rotating member may be a plate that defines the aperture, or it my be a switch-like member residing in an aperture.

Means may be provided for identifying to electronic control means of the amusement device the particular discrete, rotating position which is occupied by the rotatable member. This is preferably accomplished by an array of individual switches which are turned on and shut off respectively as the rotatable member occupies the various discrete rotating positions. Signals from these switches can then signal the electronic control means of the game, for example a microprocessor, so that the game is varied in its mode of operation or program depending on which of the discrete, temporarily-locked rotating positions is occupied. As the result of this, differing signals may be sent to the player; differing scores may be set up; new targets may be activated; and the like.

Means are also provided for releasing upon command of the microprocessor, or if desired the player, the temporary lock of the rotating positions to allow the rotatable member to rotate. Means are then provided for rotating the member back to an original, ball-receiving position upon releasing of the temporary lock.

The respective rotating positions are preferably temporarily locked by a ratchet having an array of teeth carried on the rotatable member, and retaining arm means which engages the teeth of the ratchet, to define and lock the respective rotational positions. The releasing means may comprise a solenoid which is positioned to disengage the retaining arm from the ratchet, typically by actuation of the solenoid. However, deactuation of an operating solenoid may also be used. The arm is preferably spring biased to snap into engagement with the teeth when permitted to do so by the solenoid. The number of teeth present typically depends on the number of discrete rotating positions desired.

The means for rotating the rotatable member back to an original, ball-receiving position may be accomplished simply by a spring which biases the rotatable member back toward position. Thus, since springs store energy in a cumulative manner as they are extended, the rotation of the rotatable member from each discrete, rotating position can impart a different kinetic energy to a ball in the aperture, so that balls are thrown out of the aperture at varying velocities, depending upon the particular discrete, rotational position occupied by the rotatable member.

Also, it is preferred for track means to define a rolling path for balls to the aperture. The track means and aperture are preferably sloped to cause balls to roll out of and away from the aperture when the rotatable member is in its original, ball-receiving position. However, if the velocity of the ball entering the aperture is sufficient to rotate the rotatable member to one of the discrete, temporarily locked rotating positions, then the ball typically remains captured in the aperture.

DESCRIPTION OF SPECIFIC EMBODIMENT

Figure 1:
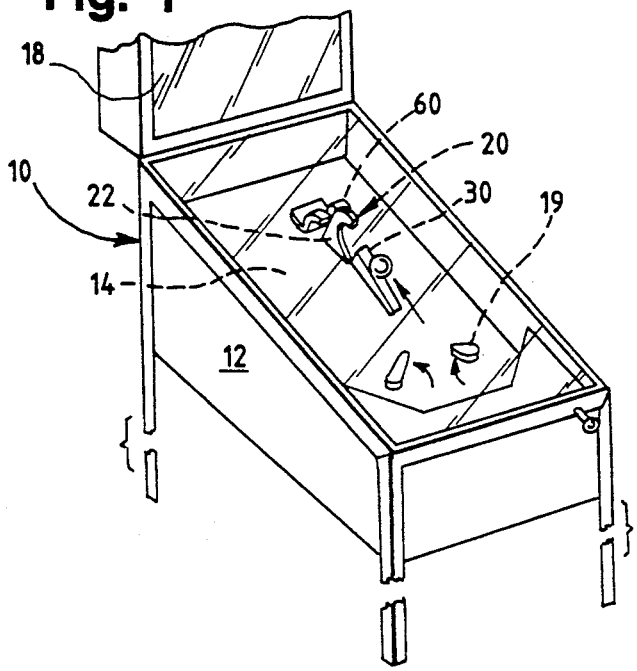
FIG. 1 is a perspective view of a pinball machine which carries the ball-receiving device of this invention.

Referring to the drawings, FIG. 1 discloses a pinball machine 10 having a frame 12 and a playfield 14 which is sloped slightly to the front, to permit free pinballs to roll toward the player, in conventional manner. Backboard 18 is also conventionally provided.

Flippers 19 are also present, being typically manually operated by the user.

In accordance with this invention, a ball receiving device 20 faces the pinball machine flippers 19, for example as a target for the flippers to shoot at, although other configurations and uses of the device of this invention in ball amusement devices are also contemplated to be within the scope of this invention.

Ball receiving device 20 comprises a vertically positioned plate 22 which rotates about pivot 24. Pivot 24 is attached to bracket 26, which, in turn, is attached to a flat member comprising playfield 14.

Rotatable plate 22 projects upwardly through the playfield to present a ball receiving aperture 28 which, in the ball-receiving position shown, communicates with a pair of spaced rails 30 which serves a track for a ball 32, to guide rolling ball 32 into aperture 28.

As ball 32 rolls into aperture 28, it strikes the wall of plate 22 that defines the aperture, imparting counterclockwise rotational kinetic energy to rotatable plate 22 about pivot 24. As plate 22 rotates in counterclockwise manner, its bottom edge defining an array of specifically four ratchet teeth 34 is rotated so that one of the teeth 34 enters into engagement with plate 36. Plate 36 is attached to the operating arm 37 of a solenoid 38, with plate 36 and the remainder of operating arm 37 being biased by spring 40 outwardly to press against vertical plate 22, until drawn downwardly toward solenoid 38 by actuation of the solenoid. Ball 32 is held in aperture 28 in any of these rotated positions where a tooth 34 engages plate 36.

Reinforcing member 42 is provided to strengthen the system by reinforcing arm 37 when it reaches its desired, outwardmost position relative to solenoid 38.

Figure 2:
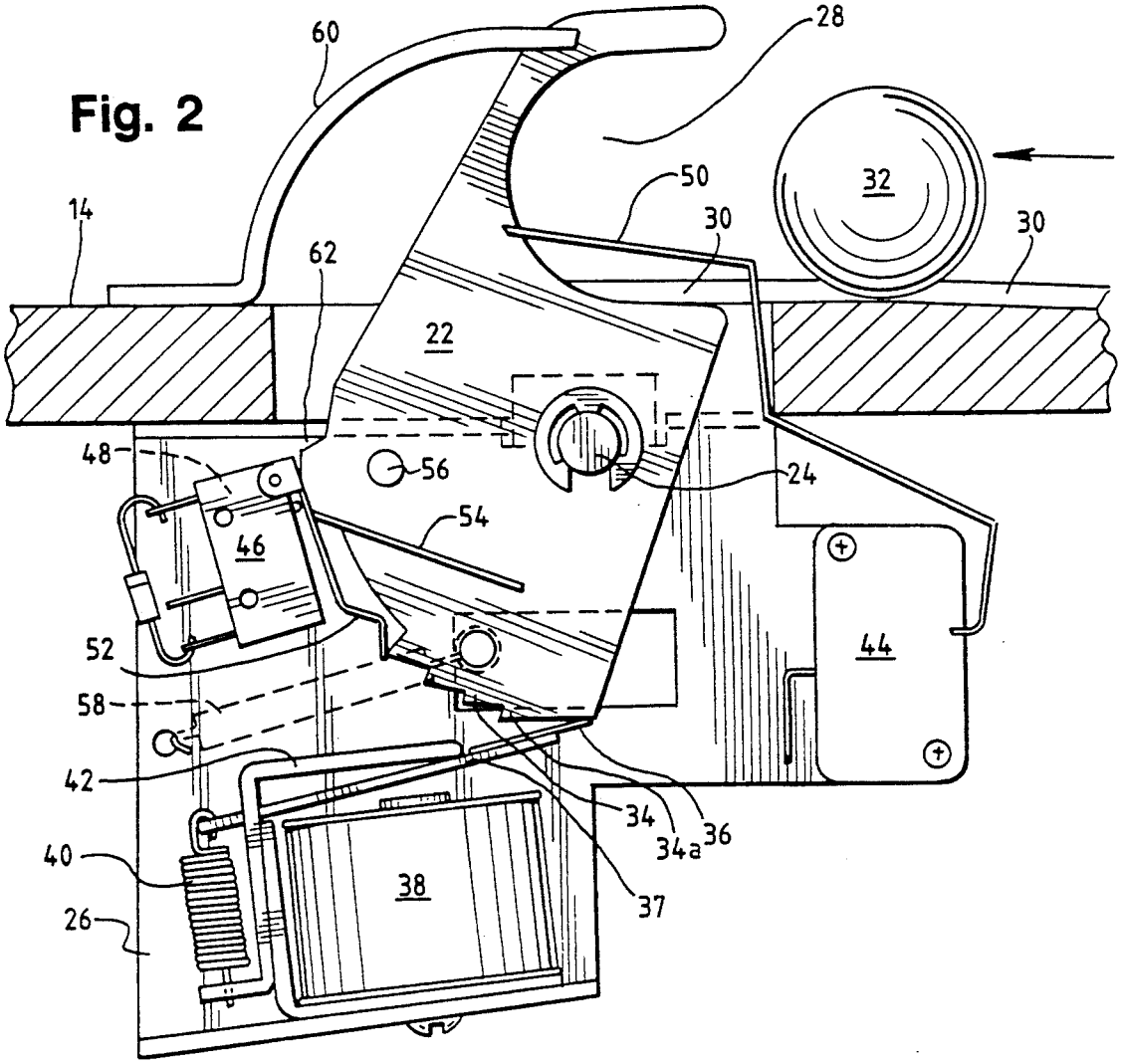
FIG. 2 is an enlarged, fragmentary elevational view, taken partly in section, of the pinball machine playfield and the apparatus of this invention.

Electronic sensor switches 44, 46, 48 are provided, the third switch 48 being positioned directly behind switch 46 in FIG. 2. Each of the respective switches may be microswitches, having an operating actuator arm which may be deflected. Actuator arm 50 is with switch 44; actuator arm 52 is with switch 46; and actuator arm 54 is with switch 48.

Thus, in the position as shown in FIG. 2, if a ball rolls into aperture 28 without adequate kinetic energy to significantly move rotatable plate in counterclockwise manner, it will depress actuator arm 50 to activate switch 44, but then the ball will immediately roll out of aperture 28 along tracks 30 again, because of the slight slope of the tracks and aperture 28 in that position.

However, if the ball enters aperture 28 with enough kinetic energy to rotate plate 22 to a first position in which plate 36 engages the right hand tooth 34*a*, then actuator arm 50 will be depressed by the ball on a continuous rather than a transient basis, to actuate switch 44 for a longer period of time. Switches 46, 48 remain unactuated.

Thus the single actuation of switch 44 for a minimum period of time is an indication that the ball has rotated plate 22 into a first operating position. The software of the game can cause an appropriate game playing response to this, such as a special score.

If ball 32 strikes with greater kinetic energy, then vertical plate 22 is rotated so that the second tooth 34 engages plate 36 of retaining arm 37. In this circumstance, switch 44 remains actuated. Actuator arm 52 of switch 46 is also actuated by direct contact with plate 22, while arm 54 of switch 48 is not actuated. Thus in this second position, a different signal can be sent to the game software for differing game play action.

If ball 32 strikes rotatable plate 22 with force sufficient to rotate plate 22 for engagement of the third tooth by retaining arm 37, stud 56 which is carried on plate 22 will engage actuator arm 54 of switch 48, so that all three switches are on. Arm 54 is positioned to one side of plate 22 to permit this. By this means, a third signal can be sent to the software for a third modification of game play.

Figure 3:
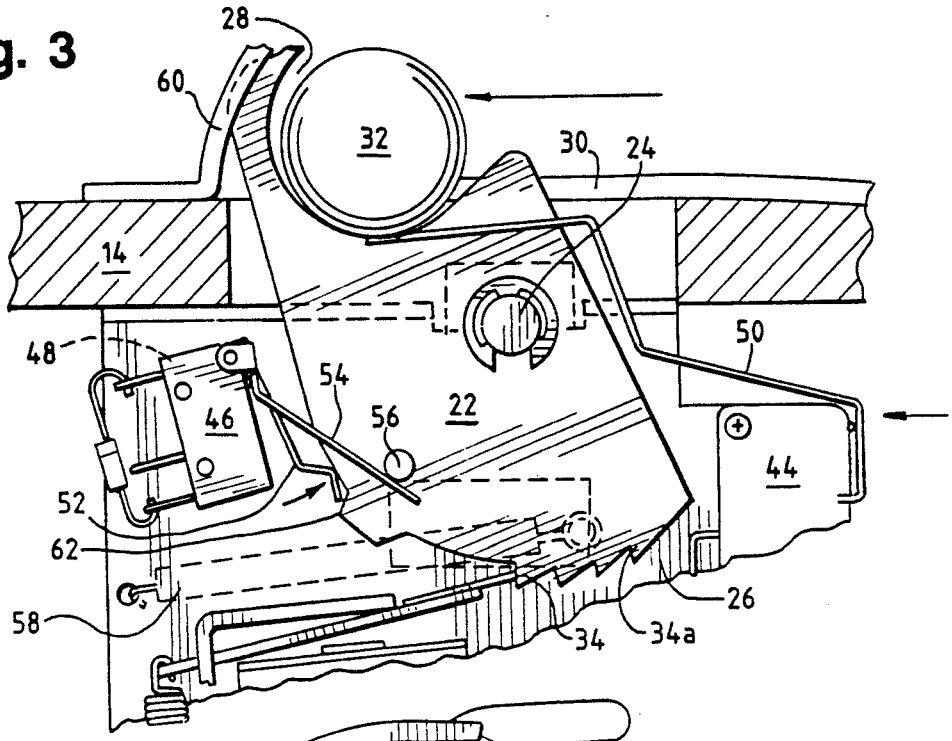
FIGS. 3 and 4 are views similar to FIG. 2, showing the device in different stages of operation.

If ball 32 strikes plate 22 so hard that it rotates fully to cause retention arm 37 to engage the fourth tooth 34, as in FIG. 3, actuator arm 52 of switch 46 is released to close switch 46. This is accomplished by the presence of recess 62 in plate 22. The remaining switches stay in their "on" position, for a fourth signal to be sent to the game software, for a fourth variety of game play.

Figure 4:
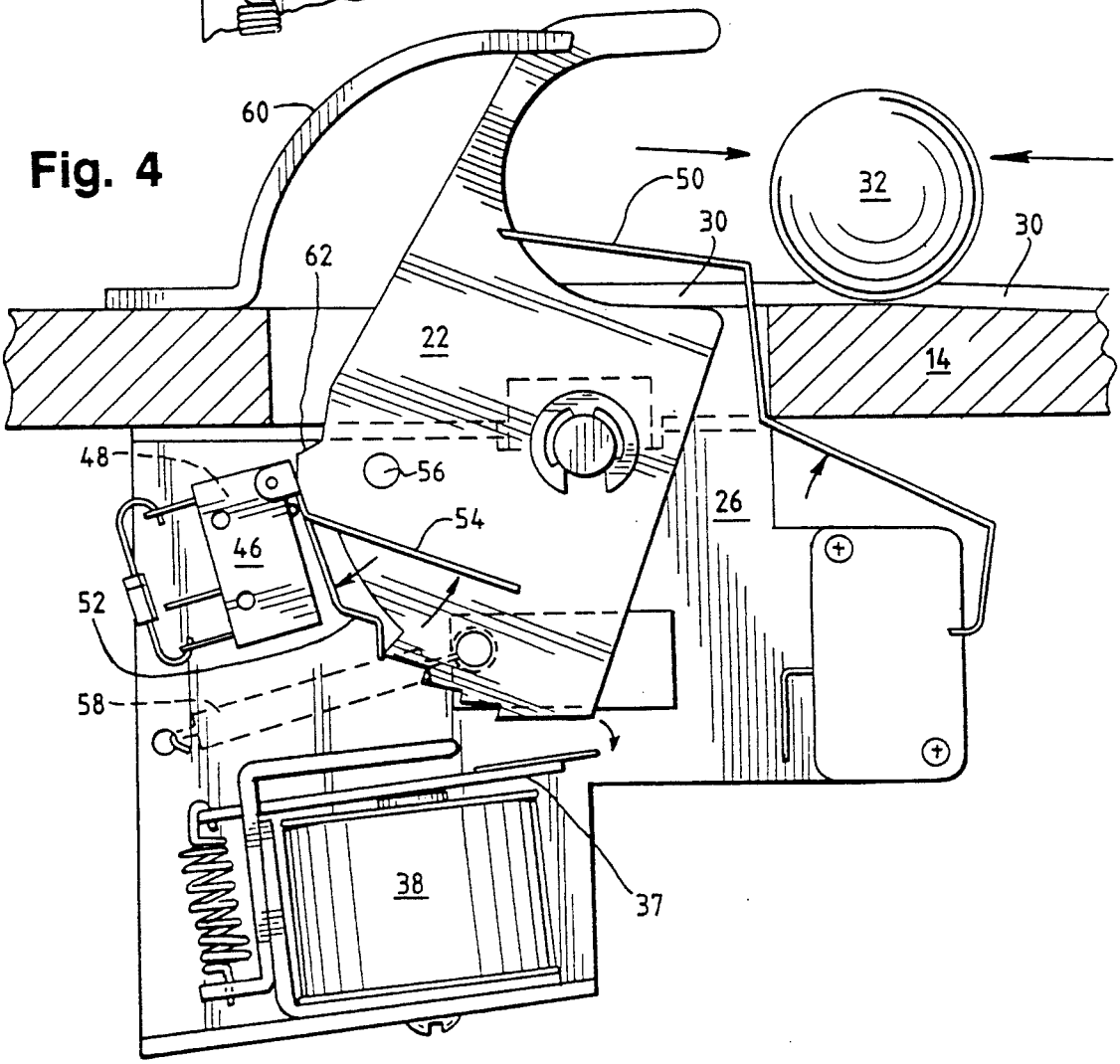

At a desired point in the game, ball 32 can be released from its seating in aperture 28. This is accomplished by the game software, or manually, if desired, by actuation of solenoid 38, which draws retainer arm 37 and plate 36 out of its engagement with one of the teeth 34. Spring 58 is attached to plate 32 and to bracket 26, to urge rotation of plate 22 in the clockwise direction. Thus, as solenoid 38 pulls retainer arm 37 out of its engagement with one of the teeth 34, rotatable plate 22 snaps in the clockwise direction to propel ball 32 down the tracks 30, as in FIG. 4. The force of this snap will be dependent upon the particular tooth 34 which is engaging plate 36 and retainer arm 37 at the time of release, due to the differing amounts of stored energy in spring 58 in the various rotating positions, so that ball 32 will be propelled with any of four different characteristic velocities by the rotary snap back of plate 22.

Deflector member 60 is provided to prevent overrotation and lateral bending of plate 32 with a ball carried in aperture 28. Plate 22 passes within a slot in deflector member 60.

Thus, by this invention, a new game function is provided for rolling ball amusement devices, which provides a significant target, if desired, for shooters, and in which the game response can be significantly variable from play to play.

The above has been offered for illustrative purposes only, and is not intended to limit the scope of the invention of this application, which is as defined in the claims below.

That which is claimed is:

1. A rolling ball amusement device, which comprises:

a frame and a playfield carried by said frame;

a rotatable member located on the playfield and positioned to receive a rolling ball to cause said member to rotate to one of a plurality of discrete, temporarily locked rotating positions depending on the amount of kinetic energy transferred by the ball to said rotatable member;

a means for releasing the temporary lock and for rotating said member back to an original, ball-receiving position upon said releasing, and to propel the ball away from said member with a velocity that depends on the particular discrete rotating position achieved.

2. A rolling ball amusement device as defined by claim 1, in which said rotating positions are temporarily locked by a ratchet and retaining arm, and in which the releasing device comprises a solenoid positioned to disengage said retaining arm from the ratchet.

3. A rolling ball amusement device as defined by claim 2, in which said releasing means further includes a spring, whereby rotation of said member from each discrete, rotating position imparts a different kinetic energy to a ball released from said member.

4. A rolling ball amusement device as defined by claim 1, in which a track defines a rolling path for balls to said member, said track being sloped to cause balls to roll out of and away from said member when the rotatable member is in said original, ball-receiving position.

5. A rolling ball amusement device as defined by claim 1, in which said amusement device comprises an electronic control for identifying the discrete rotating position occupied by said rotatable member.

6. A rolling ball amusement device, which comprises:

a frame and a playfield supported by said frame;

a rotatable member located on the playfield, positioned to receive a rolling ball to cause said member to rotate to one or a plurality of discrete, temporarily locked rotating positions depending upon the amount of kinetic energy transferred by the ball to said rotatable member;

switches associated with said rotating positions to provide signals to an electronic control system, to provide a variety of game play depending upon the rotating position achieved;

a means for releasing the temporary lock and for rotating said member back to an original, ball receiving position upon said releasing, and to propel the ball away from said member with a velocity that depends on the particular discrete rotating position achieved.

7. A rolling ball amusement device as defined by claim 6, in which said rotating positions are temporarily locked by a ratchet and retaining arm, and the releasing means comprises a solenoid positioned to disengage said retaining arm from said ratchet, and a spring connected to said rotating member for rotating said rotating member back to an original, ball-receiving position with a force that is dependent upon the particular discrete rotating position achieved.

8. A rolling ball amusement device, which comprises:

a frame and a playfield carried by said frame;

a rotatable member located on the playfield and positioned to receive a rolling ball, said rotatable member being rotated a variable distance depending upon the kinetic energy transferred by the ball to said rotating member; and a means for rotating said member back to an original, ball-receiving position and to propel the ball away from said member with a velocity that depends upon the kinetic energy of the ball when it was received by the rotating member.

* * * * *